United States Patent [19]

Sidney

[11] 4,361,999

[45] Dec. 7, 1982

[54] SELF-SUPPORTING TRANSVERSE PARTITION WALL SUPPORT

[76] Inventor: Albert W. Sidney, 18433 Westbrook Dr., Livonia, Mich. 48152

[21] Appl. No.: 188,983

[22] Filed: Sep. 19, 1980

[51] Int. Cl.[3] ..... E04C 3/00; E04C 5/18

[52] U.S. Cl. ..... 52/696

[58] Field of Search ..... 52/696, 693, 348, 349, 52/488, 364, 660, 46–51; 403/232.1, 230

[56] References Cited

U.S. PATENT DOCUMENTS 651,139 6/1900 Gays ..... 52/51
1,461,704 7/1923 Bonsall ..... 52/51
1,558,239 10/1925 Costello ..... 52/46
1,614,334 1/1927 Wright ..... 52/49
2,964,807 12/1960 Kennedy ..... 52/696

*Primary Examiner*—James L. Ridgill, Jr.
*Attorney, Agent, or Firm*—Robert G. Mentag

[57] ABSTRACT

A transverse support member for mounting between two adjacent joists in a building, to support a weight bearing partition wall which is disposed between the two floor joists of the building. The transverse support member is self-supporting, and it includes an elongated trough shaped body with floor engaging means, and attachment means on the ends thereof for attaching the transverse support member to the two adjacent joists.

7 Claims, 20 Drawing Figures

SELF-SUPPORTING TRANSVERSE PARTITION WALL SUPPORT

BACKGROUND OF THE INVENTION

1. Field of the Invention

This invention relates to the building construction art, and more particularly, to a novel and improved weight bearing partition wall support member. The invention is specifically concerned with a self-supporting, transverse support member for mounting between two adjacent parallel, floor joists in a building to support a weight bearing partition wall which is disposed parallel to the two adjacent floor joists, and in a position between the two adjacent floor joists.

2. Description of the Prior Art

It is well known in the building construction art to employ a blocking structure to support a partition wall which is parallel to two floor joists and disposed in a position between the two joists. One prior art method for providing such partition wall blocking is to employ a plurality of 2×4's, or the like, between two adjacent floor joists and support the 2×4's with cleats at the ends thereof. A disadvantage of the aforementioned prior art blocking structure is that it is not standardized, and the size of the 2×4's, or other parts used are left to the carpenters on the job to select without actually determining whether or not said blocking structure are strong enough to support a particular weight bearing partition wall.

An example of such prior art type blocking structure is shown in FIG. 14 of the specification, and described in the same. Another prior art type blocking structure for partition walls is shown in FIG. 16 of the specification and described in the same. A disadvantage of the last mentioned prior art blocking structure is that it is not suitable for supporting a weight bearing partition wall. Still another prior art blocking structure for partition walls is shown in FIG. 18 of the specification and described in the same. A disadvantage of the last mentioned blocking structure is that it is expensive and time consuming to install, and it blocks out the area between two joists so that conduits and other structure cannot be run between the joists without spending money to cut out suitable passage holes through the blocking structure.

An example of a prior art joist spacer and support is illustrated in U.S. Pat. No. 2,964,807. The joist spacer and support shown in this patent is not adapted for providing additional support for a partition wall, and it is more expensive to fabricate than the support member of the present invention.

SUMMARY OF THE INVENTION

In accordance with the present invention, the self supporting transverse support member for weight bearing partition walls comprises an elongated body which may be termed a trough-shaped body. Said body is long, narrow and open along one end. In one embodiment of the invention, body includes a flat bottom end wall, and a pair of integral, upwardly and outwardly diverging side walls with a floor engaging horizontal flange integrally formed along the upper end of each of the side walls. A centrally mounted hanger flange is integrally formed along each end of the bottom end wall and it extends upwardly with outwardly diverging sides. An upper portion of each hanger flange is bent at 90° to form a horizontal hanger portion. The first embodiment is further provided with a pair of vertical attachment end flanges formed integrally at each end of each side wall. The hanger and end flanges are adapted to be secured to a floor joist by any suitable means, as by nails.

A second embodiment of the invention is constructed in the same manner as the first embodiment, with the exception that the side walls are parallel and the central hanger flange is deleted.

A third embodiment of the invention is constructed similar to the first embodiment, but it is used in a position with the bottom end wall turned upwardly to form a top end wall for engagement with a floor board. A central hanger flange is integrally connected to each end of the top end wall, and it is extended horizontally, and longitudinally outward therefrom for engagement with the top of the floor joists. The support member of the invention may be formed from a strip of suitable sheet material, of any suitable gauge, in accordance with the weight to be supported by the support member. A plurality of said support means would be employed and they would be spaced along the top of the floor joists, for carrying out the function of supporting a weight bearing partition wall.

Other features and advantages of this invention will be apparent from the following detailed description, appended claims, and the accompanying drawings.

DESCRIPTION OF THE PREFERRED EMBODIMENTS

Figure 1:
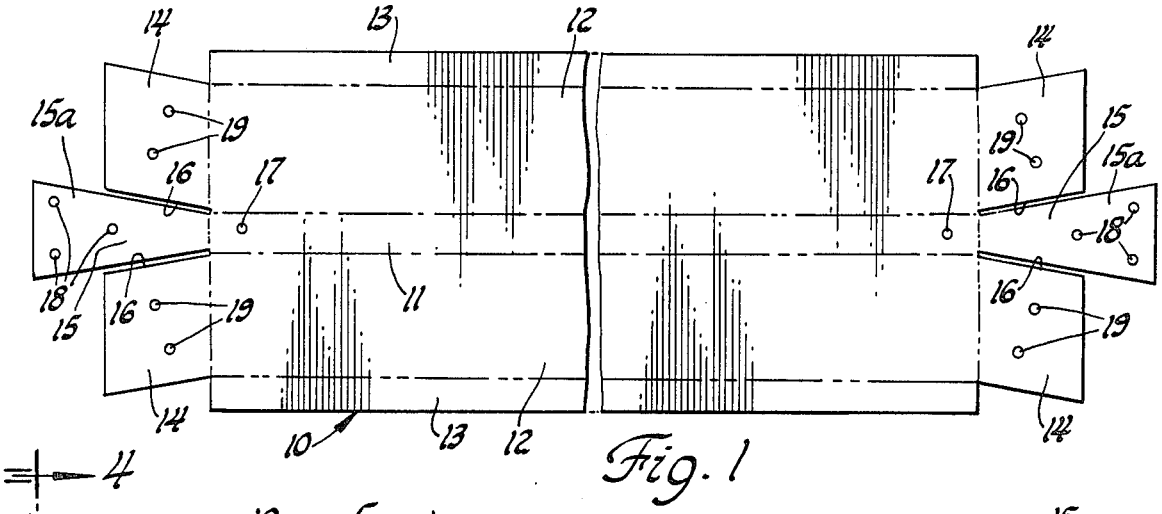
FIG. 1 is a layout view of a first embodiment of a self-supporting, transverse, weight bearing partition wall support, showing how said first embodiment is made from a sheet of galvanized steel.

Referring now to the drawings, and in particular, to FIGS. 1–5, the numeral 10 generally designates a first embodiment of a self-supporting, transverse, weight bearing partition wall support member.

FIG. 1 shows the support member 10 in a layout or planar blank view, and showing how it may be made from a sheet of galvanized steel.

FIGS. 2–5 show the support mamber layout or blank of FIG. 1 folded and bent into its final form.

Figure 2:
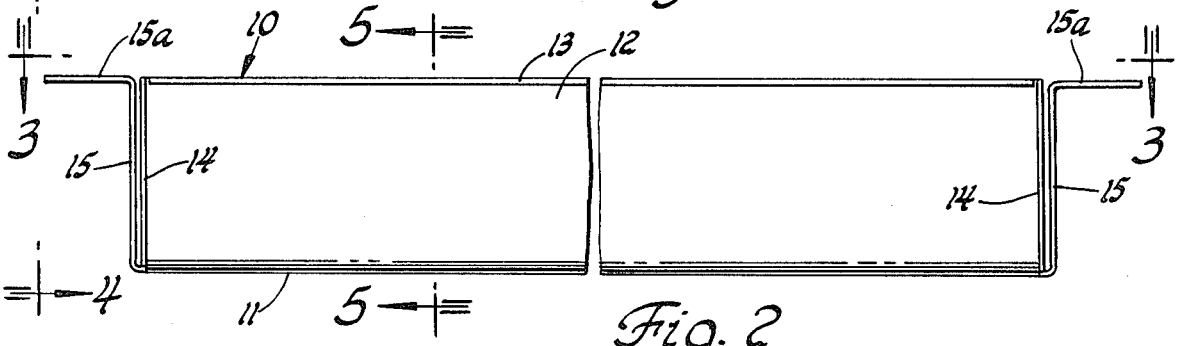
FIG. 2 is a side elevation view of the first embodiment of FIG. 1, showing said first embodiment folded and bent into its final form.
Figure 3:
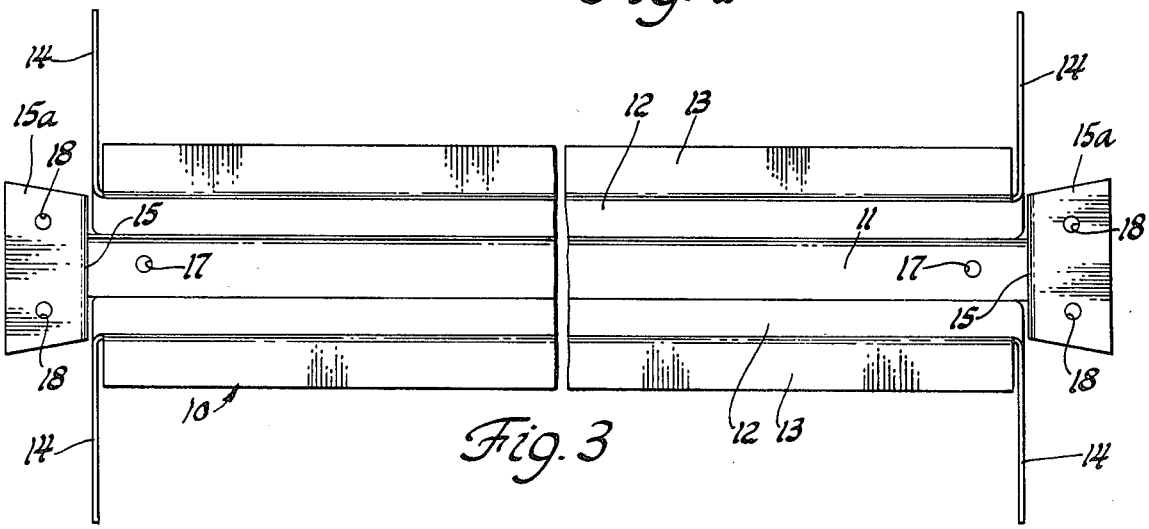
FIG. 3 is a top plan view of the structure illustrated in FIG. 2, taken along the line 3—3 thereof, and looking in the direction of the arrows.
Figure 4:
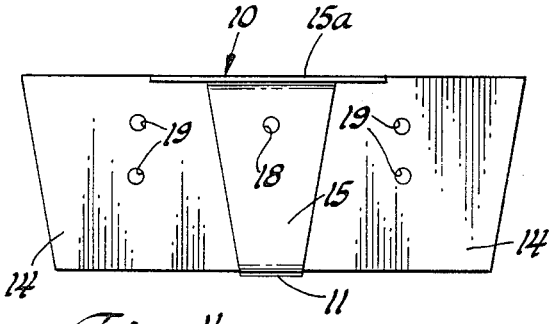
FIG. 4 is a left end elevation view of the structure illustrated in FIG. 2, taken along the line 4—4 thereof, and looking in the direction of the arrows.
Figure 5:
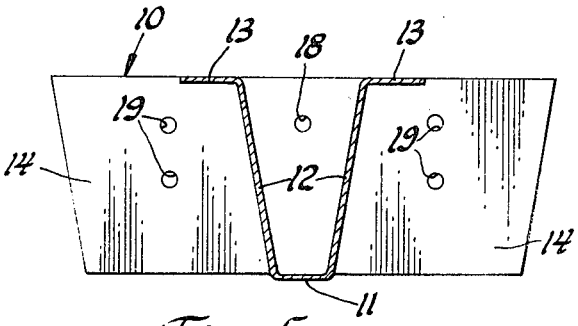
FIG. 5 is an elevational section view of the structure illustrated in FIG. 2, taken along the line 5—5 thereof, and looking in the direction of the arrows.

As best seen in FIGS. 2 through 5, the support member 10 includes a flat, elongated bottom end wall 11 which is integrally attached along its outer edges to the lower ends of a pair of integral side walls 12. As best seen in FIG. 5, the integral side walls 12 extend upwardly from the bottom end wall 11, and they diverge from each other so as to form a long, narrow support body which is open at the top. As best seen in FIGS. 3 through 5, an outwardly extended, floor engaging flange 13 is integrally attached along its inner edge to each of the upper ends of the side walls 12.

As shown in FIGS. 1, 2 and 3, a hanger member 15, 15*a* is integrally attached at its lower end to each of the longitudinal ends of the bottom end wall 11. Each of the hanger members includes a lower vertical portion 15 and an upper, integral horizontal portion 15*a*. The hanger members 15, 15*a* are provided with suitable nail holes 18 for nailing the support member 10 to a pair of adjacent joist members. The numerals 16 in FIG. 1 designate the inner edge of each of a pair of integral attachment flanges 14 which are integrally attached at their inner ends to an adjacent end of one of the side walls 12. As shown in FIGS. 1, and 3 through 5, each end of the support members 10 is provided with a pair of attachment flanges 14, and they are disposed on opposite sides of the adjacent centrally located hangers 15, 15*a*. Each of the attachment flanges 14 is provided with a plurality of suitable nail holes 19. As shown in FIGS. 1 and 3, the bottom end wall 11 is provided with a pair of weep holes 17.

Figure 6:
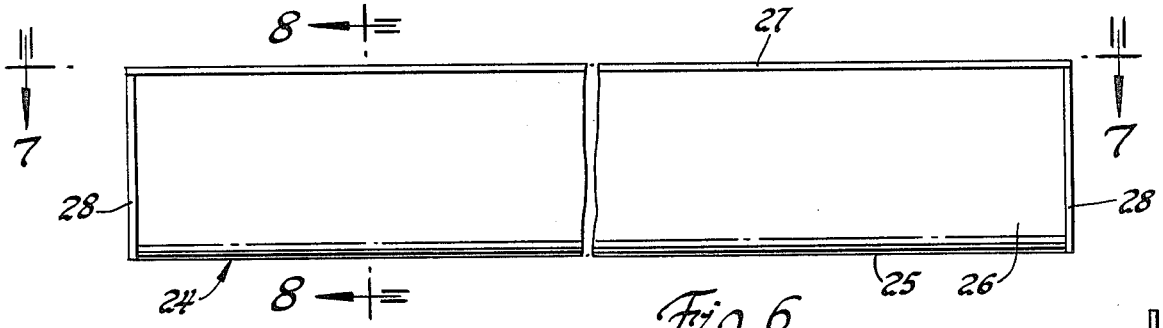
FIG. 6 is a side elevation view of a second embodiment of the invention.
Figure 7:
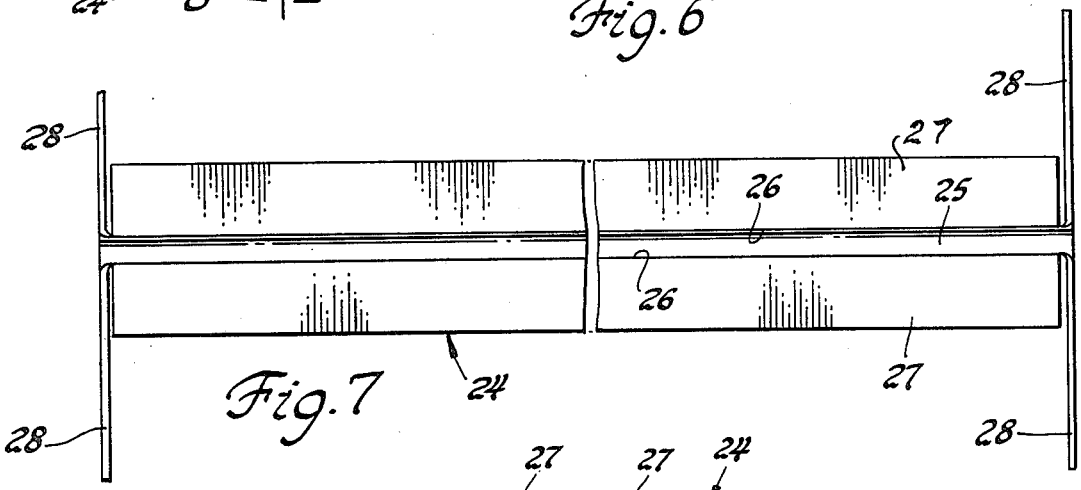
FIG. 7 is a top plan view of the structure illustrated in FIG. 6, taken along the line 7—7 thereof, and looking in the direction of the arrows.
Figure 8:
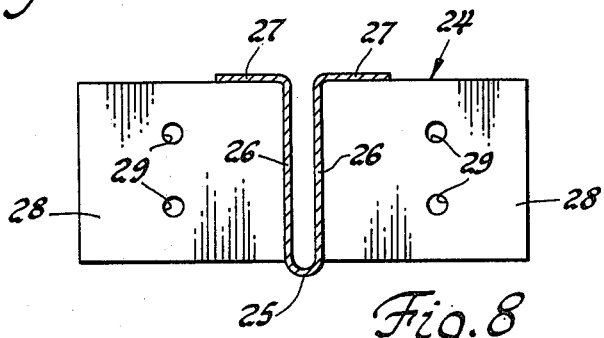
FIG. 8 is an elevational section view of the structure illustrated in FIG. 6, taken along the line 8—8 thereof, and looking in the direction of the arrows.
Figure 9:
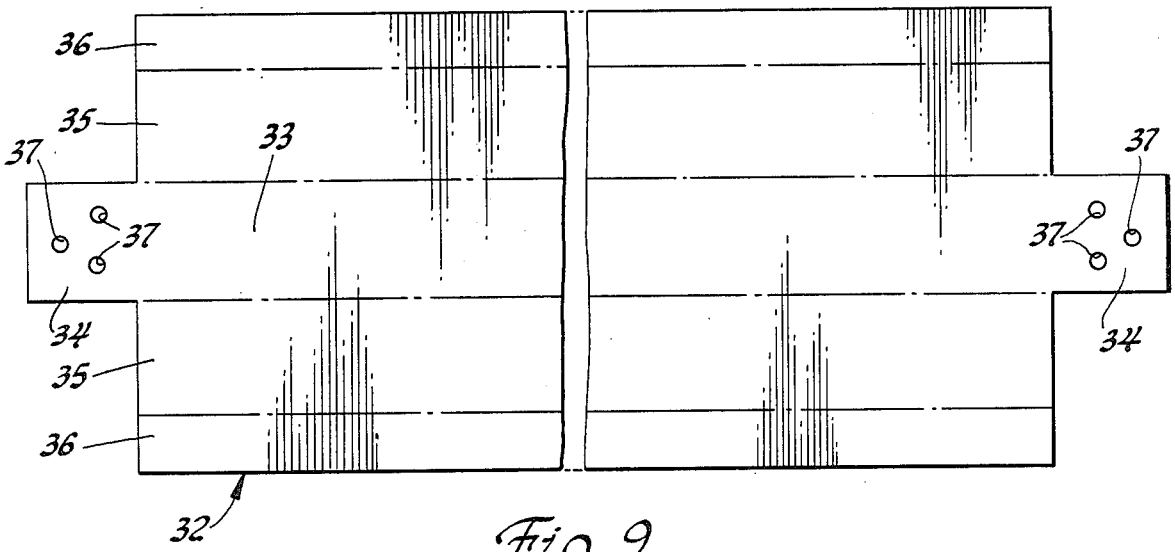
FIG. 9 is a layout view of a third embodiment of the invention, showing how it is made from a sheet of galvanized steel.

FIGS. 6, 7 and 8 illustrate a second embodiment of a self-supporting, transverse, weight bearing partition wall support member which is generally indicated by the numeral 24. The support member 24 includes a U-shaped bottom end wall 25 to which is attached a pair of integral, vertical side walls 26. As shown in FIGS. 7 and 8, an elongated horizontal floor engaging flange 27 is pivotally attached along the outer, inner edge of the upper end of each of the vertical side walls 26.

As best seen in FIGS. 7 and 8, the support member 24 is provided at each end with a pair of vertical attachment flanges 28, which have their inner ends integrally attached to the adjacent ends of the side walls 26. The attachment flanges 28 at each end of the support member 24 extend sidewardly outward at right engles to the longitudinal axis of the elongated support member 24. As illustrated in FIG. 8, each of the attachment flanges 28 is provided with a plurality of suitable nail holes 29.

Figure 10:
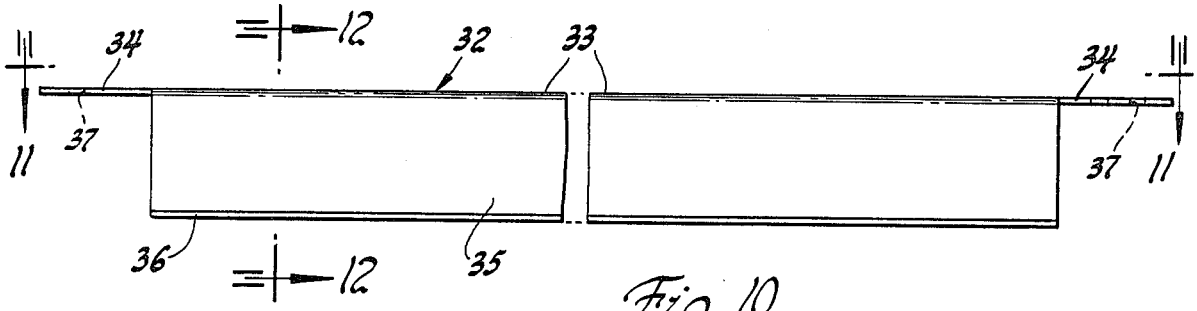
FIG. 10 is a side elevation view of the third embodiment of FIG. 9, and showing it folded and bent into its final form.
Figure 11:
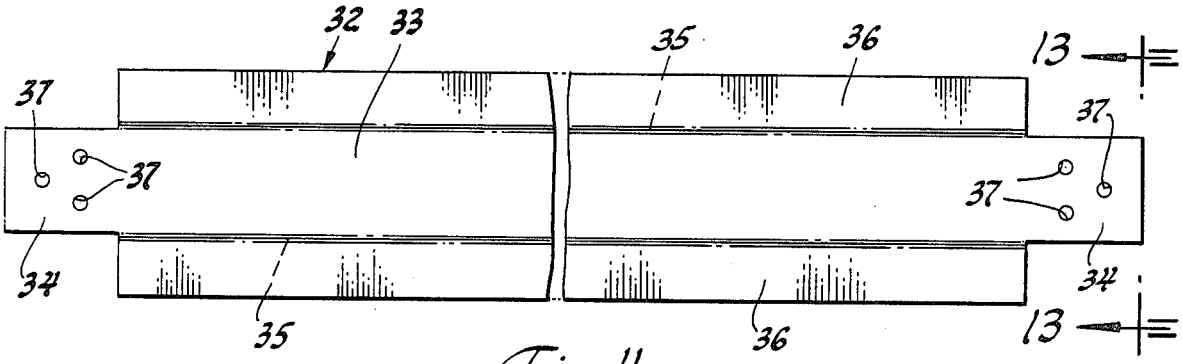
FIG. 11 is a top plan view of the structure illustrated in FIG. 10, taken along the line 11—11 thereof, and looking in the direction of the arrows.
Figure 12:
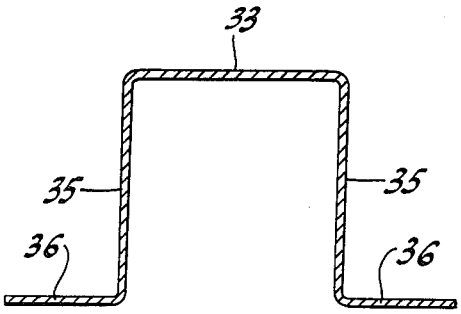
FIG. 12 is an elevational section view of the structure illustrated in FIG. 10, taken along the line 12—12 thereof, and looking in the direction of the arrows.
Figure 13:
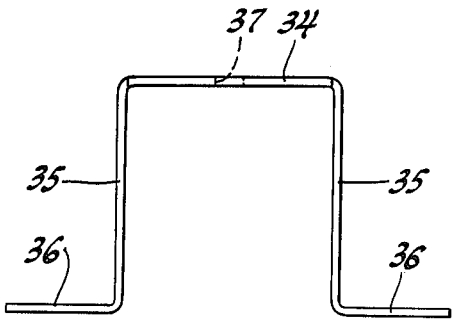
FIG. 13 is a right end view of the structure illustrated in FIG. 11, taken along the line 13—13 thereof, and looking in the direction of the arrows.

FIGS. 9 through 13 illustrate a third embodiment of a self-supporting, transverse, weight bearing partition wall support member which is generally indicated by the numeral 32. The support member 32 includes a flat, floor engaging, top end wall 33 which is integrally attached along its outer edges to the upper ends of a pair of integral, parallel, vertical walls 35. As best seen in FIGS. 10 and 11, an outwardly extended flange 36 is integrally attached along its inner edge to each of the lower ends of the side walls 35. As shown in FIGS. 9, 10, 11 and 13, an attachment hanger flange 34 is integrally attached to each end of the top end wall 33. As shown in FIGS. 10 and 11, each of the attachment hanger flanges 34 is provided with a plurality of suitable nail holes 37. The embodiment of FIGS. 9 through 13 functions in the position shown in FIG. 10, so that the top wall 33 is a floor engaging wall, and the hanger flanges 34 are nailed to adjacent joists.

It will be seen that the above described three embodiments of the invention are elongated, and trough shaped in cross section. The gauge of the sheet metal material employed in making the aforedescribed three embodiments of the invention depends on the center to center distance between adjacent joists with which the support member would be used. For example, if the center to center distance between adjacent joists is 16", then sheet material of 22" gauge may be employed. For other center to center distances, then other sizes of gauge material may be used to take the different loads, as for example, 18" and 22" gauge material.

Figure 14:
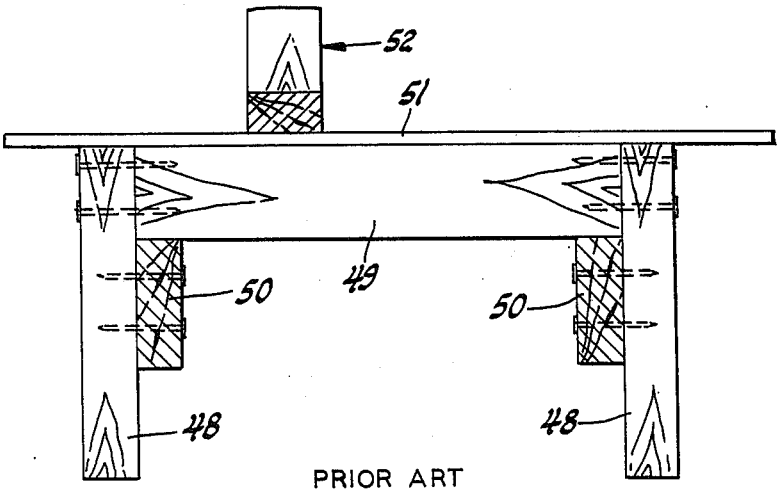
FIG. 14 is an elevation view of a first prior art weight bearing partition wall blocking structure.

Heretofore, in the building construction art, when a partition wall was not aligned with a floor joist, the floor boards for carrying such a partition wall have been supported at predetermined distances apart, by blocking, as shown in FIG. 14. In FIG. 14, the numeral 48 designates a pair of adjacent conventional joist members which carry the floor boards 51. A partition wall 52 is seated on the floor board 51 in a position between the joists 48 in order to provide support for the partition wall 52. An elongated blocking member such as a 2×4, or larger member, is nailed under the floor board 51 in a transverse position between the joists 48, as shown in FIG. 14. The transverse blocking member 49 is supported at its ends by 2×4 cleat members 50. If the partition wall 52 is a weight bearing partition wall, then the blocking member is positioned on end. A disadvantage of the last described prior art blocking structure is that it is costly and time consuming to install. Another disadvantage of the last described prior art blocking structure for partition walls is that there are no standards to determine accurately what weight such prior art blocking structures will support and accordingly, there are no standards by which a carpenter can accurately determine whether or not such blocking is sufficient for a required weight or load.

The support member of the present invention overcomes the last described disadvantages of the prior art blocking, when used with conventional joists, in that the support member of the present invention is made to support a predetermined weight, when used on predetermined center to center distances between adjacent joists, and when used in plural units at predetermined spaced apart positions along the length of a pair of joists. The support members of the present invention permits the user to quickly and easily install such support members in accordance with any required engineering specifications.

Figure 15:
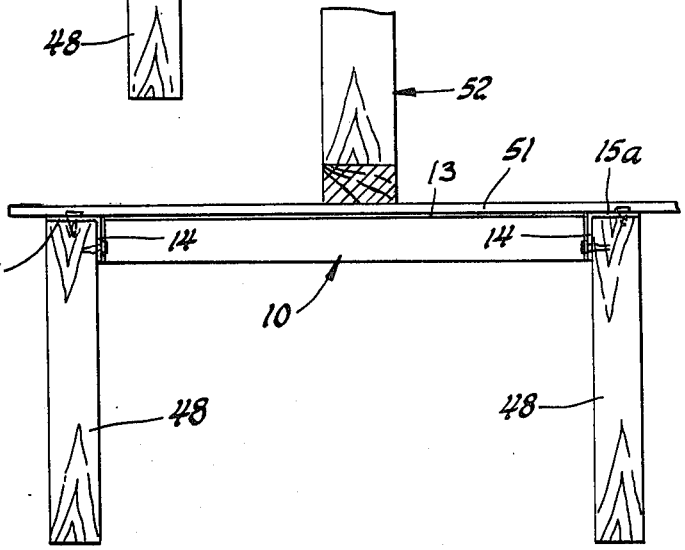
FIG. 15 is an elevational view, similar to FIG. 14, and showing the first embodiment of the invention employed as a self-supporting, transverse, weight bearing partition wall support.

FIG. 15 illustrates the use of the first embodiment of the invention, as shown in FIGS. 1 through 5, and as applied to a building construction employing conventional joists 48. The numeral 10 designates a support member made in accordance with the aforedescribed structure of the present invention. The hanger portion 15*a* is shown nailed to the top side of the joists 48, with the side attachment flanges 14 also being nailed to the inside faces of the joists 48.

The second embodiment of the invention, as shown in FIGS. 6–8, would also be nailed in place under the floor board 51 if it were used with conventional joists, as shown in FIGS. 14 and 15. The flanges 28 would be nailed to the inside faces of the joists 48 with the flanges 27 engaging and supporting the floor board 51.

The third embodiment 32 of the invention, as shown in FIGS. 9 through 13, would also be nailed in place under a floor board 51 when used with conventional joists 48, as shown in FIGS. 14 and 15. The top end wall 33 would engage and support the floor board 51, and the hanger flanges 34 would be nailed to the tops of the joists 48.

Figure 16:
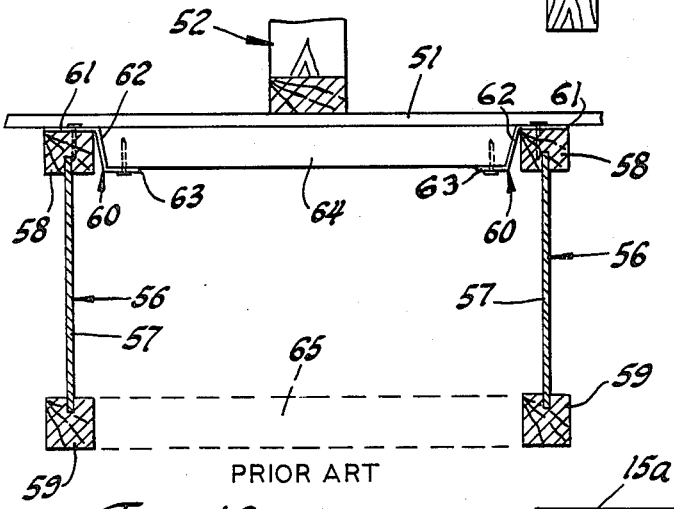
FIG. 16 is an elevational view of a second prior art weight bearing partition wall supporting structure.

FIG. 16 illustrates a man-made type joist which is employed in the building construction art, and which also illustrates how the floor board 51 is supported to carry a non-bearing partition wall. The non-bearing partition wall is generally designated by the numeral 52, and the floor boards by numeral 51. The man-made joists are generally designated by the numerals 56. The joists 56 each comprise a vertical plate or web which is formed from ply-wood, or any other suitable material. An elongated flange 58 is glued to the top of the web 56, and a similar elongated flange 59 is glued to the bottom of the web 56. A 2×4 support member 64 is mounted under the floor board 51 and it is secured to the top flanges 58, at the ends thereof, by integral z-shaped clips or brackets 60 which have an upper flange 61 nailed to the top of the flanges 58, and an in intermediate integral portion 62 and a lower flange 63, which is nailed to the inside of the 2×4 support member 64.

The support structure shown in FIG. 16 is only for blocking purposes, and for non-weight bearing purposes, and it is not adapted for supporting weight bearing partition walls. The numeral 65 designates a transverse member which may be mounted between the lower ends of the joists 56.

Figure 17:
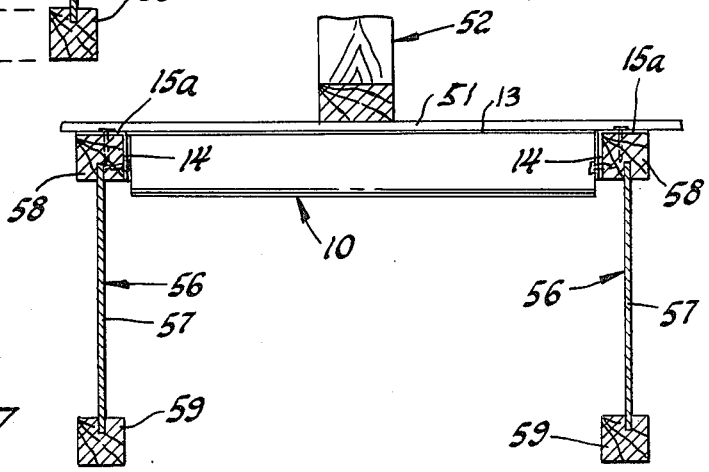
FIG. 17 is an elevational view, similar to FIG. 16, and showing the first embodiment of the invention employed with the joist structure of FIG. 16 for supporting a weight bearing partition wall.

FIG. 17 illustrates the use of the first embodiment 10 of the invention, as shown in FIGS. 1 through 5, and as applied to a building construction employing the man-made joists 56 shown in FIG. 16. The hanger portions 15*a* of the support member 10 are shown nailed to the top side of the joist top flanges 58, with the side attachment flanges 14 also nailed to the inside faces of the joist top flanges 58. When the man-made joists 57 are provided with transverse support members 10, in accordance with the present invention, these joists are then able to support weight-bearing partition walls 52 on the floor boards 51.

The second embodiment 24 of the invention, as shown in FIGS. 6–8, may also be employed with the man-made joists illustrated in FIGS. 16 and 17, in the same manner as the support member 10. The flanges 28 in said embodiment would be nailed to the inside faces of the joist top flanges 58 with the support member flanges 27 engaging and supporting the floor board 51.

The third embodiment 32 of the invention, as shown in FIGS. 9 through 13, may also be employed with the man-made joists shown in FIGS. 16 and 17. The top end wall 33 of the support member 32 would engage and support the floor board 51 and the hanger flanges 34 would be nailed on top of the joist top flanges 58.

Figure 18:
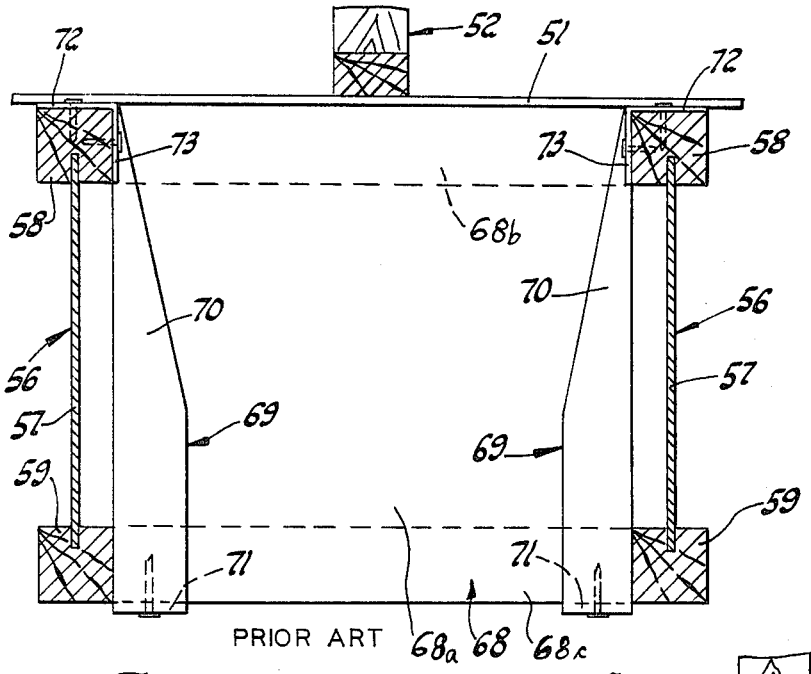
FIG. 18 is an elevational view of a third prior art structure for supporting a weight bearing partition wall.

FIG. 18 illustrates another prior art type blocking support structure employed in the building construction art. The structure shown in FIG. 18 employs the same type of man-made joist 56 as previously illustrated in FIG. 16. Mounted between a pair of joists 56 is a solid blocking material 68 which is made from the same type of structure as the joists 56. That is, the blocking material 68 includes a web 68*a*, an upper flange 68*b*, and a lower flange 68*c*. The blocking support member 68 is held in position between a pair of joists 56 by a pair of hangers, generally designated by the numeral 69. Each of the hangers 69 includes an elongated, vertically disposed body portion 70 which is formed with an upper, horizontal, integral flange 72 which is nailed to the top side of a joint flange 58. A second flange 73 is also integrally secured to the upper end of each of the hanger body portions 70, and it is secured by nails to the inner side of a joist flange 58. The lower end of each hanger 69 is provided with an integral, horizontal flange 71 which is seated under the lower support member flange 68*c*. The blocking support 68 is attached by suitable nails to said lower blocking support flange 68*c*.

A disadvantage of the prior art blocking support structure shown in FIG. 18 is that the web 60*a* blocks the passage of pipes, ducts, and the like, between the joists 56, and it is also costly and time-consuming to erect. Also, extra cost would be involved to cut holes through the blocking 68 to allow passage of pipes, and the like.

Figure 19:
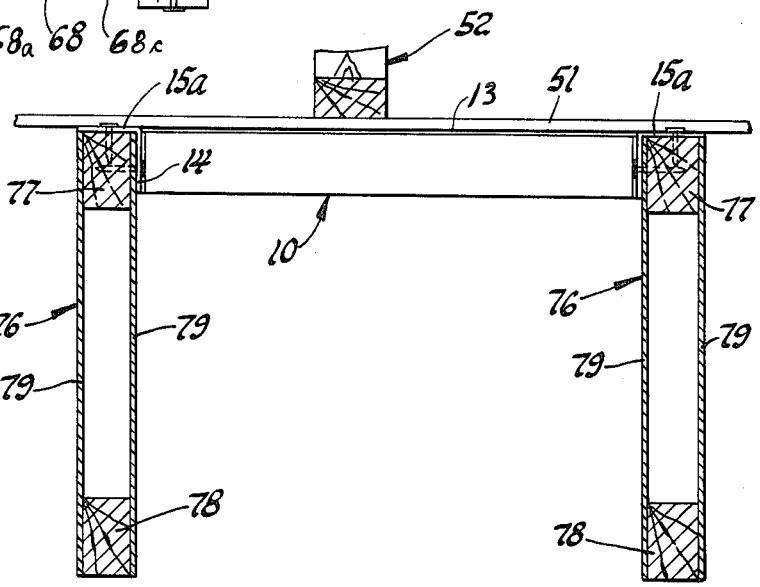
FIGS. 19 and 20 illustrate two additional views of the first embodiment of the invention employed with prior art type building joists.

FIG. 19 illustrates the use of the first embodiment support member 10 with another type of man-made building joists, generally indicated by the numerals 76. Each of the joists 76 is made from an upper flange 77, as a 2×4, or the like, and a lower flange 78, as a 2×4, or the like. The flanges 77 and 78 are connected by a web structure comprising a pair of spaced apart sheets of plywood 79 which are attached as by glueing, or other means, to the inner and outer sides of the flanges 77 and 78.

The support member 10 has its flanges 15*a* attached by nails to the top sides of the flanges 77, with the side attachment flanges 14 also nailed to the inner plywood sheet 79. The flanges 13 engage the floor board 51 for supporting a weight bearing partition wall 52.

The second and third embodiment support members 24 and 32 may be used with the man-made joists 76 in the same manner as described hereinafter for the man-made joists of FIG. 17.

Figure 20:
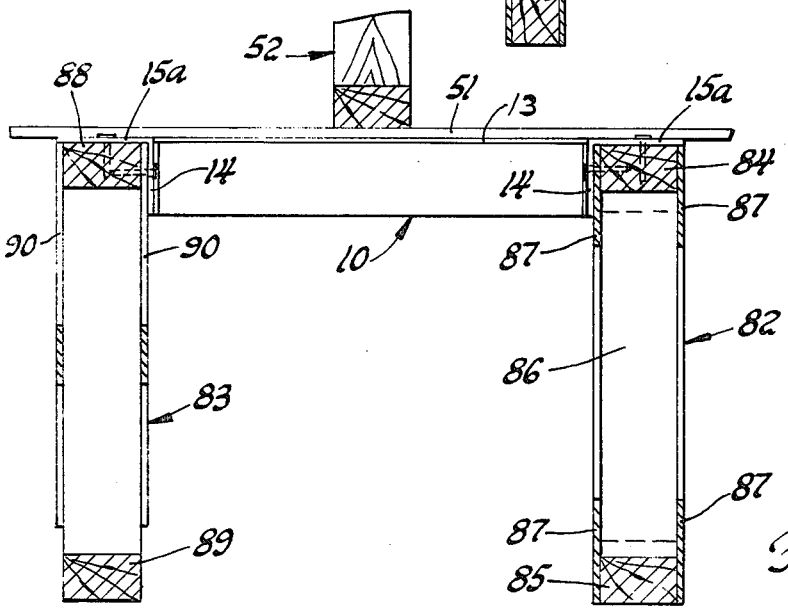

FIG. 20 illustrates the use of the first embodiment support member 10 with still another type of man-made building joists, generally indicated by the numerals 82 and 83.

The joist 82 includes an upper flange 84 and a lower flange 85 which are connected by strips of wood or metal, indicated by the numeral 87. The connecting strips 87 are angularly disposed, and secured to the flanges 84 and 85 by any suitable means, as by gluing and the like. The joist 83 is formed in a similar manner and includes an upper flange 88 and a lower flange 89, and interconnecting strips of material 90. The flanges 84, 85, 88 and 89 may be formed of any suitable material, as for example, from 2×4's, and the like.

A support member 10 has its flanges 50*a* attached by nails to the top side of the flanges 77, with a side attachment flange 14 also nailed to the inner side of each of the joists 82 and 83. The flanges 13 engage the floor board 51 for supporting the wood bearing partition wall 52.

The second and third embodiment support members 24 and 32 may be used with the man-made joists 82 and 83 in the same manner as described hereinbefore for the man-made joists shown in FIG. 17.

While it will be apparent that the preferred embodiments of the invention herein disclosed, are well calculated to achieve the results aforestated, it will be appreciated that the invention is susceptible to modification, variation and change.

What is claimed is:

1. A self-supporting, transverse support member for mounting between two adjacent, parallel floor joists to support a weight bearing partition wall concentrated load which is disposed between the two floor joists, characterized in that said support member includes:

(a) an elongated trough shaped body;

(b) said trough shaped body having a horizontal flat upper end provided with floor engaging means along the entire length thereof for supporting a building floor which carries a weight bearing partion wall concentrated load;

(c) integral attachment means on each end of said trough shaped body; and, (d) means for securing the attachment means on each end of said trough shaped body to an adjacent floor joist.

2. A partition wall support member as defined in claim 1, characterized in that:

(a) said trough shaped body includes a flat, horizontal top end wall, an integral side wall extends downwardly from each side edge of the top end wall, and an integral flange is extended sidewardly outward from the lower end of each side wall.

3. A partition wall support member as defined in claim 2, characterized in that:

(a) an attachment hanger flange is integrally attached to each end of the top end wall, and it extends horizontally and longitudinally outward from the top end wall for seating on top of an adjacent floor joist for attachment thereto.

4. A partition wall support member as defined in claim 1, characterized in that:

(a) said trough shaped body includes a bottom end wall, and a pair of integral side walls extending upwardly from the bottom end wall, and a floor engaging flange integrally attached to the upper end of each side wall along the entire length thereof.

5. A partition wall support member as defined in claim 4, characterized in that:

(a) said attachment means on each end of the trough shaped body includes an integral attachment flange, perpendicularly formed on the end of each side wall for attachment to the inner face of an adjacent floor joist.

6. A partition wall support member as defined in claim 5, characterized in that:

(a) an attachment hanger flange is integrally attached at its lower end to each end of the bottom end wall, and it has an upper end bent to seat on the top of an adjacent floor joist for attachment thereto.

7. A partition wall support member as defined in claim 6, characterized in that:

(a) the bottom end wall is flat and horizontal, and the side walls extend upwardly from the bottom end wall in diverging directions.

* * * * *